United States Patent [19]

Stevens

[11] Patent Number: 5,022,377

[45] Date of Patent: Jun. 11, 1991

[54] PORTABLE BOW PRESS

[76] Inventor: Richard L. Stevens, Rte. 1, Box 134, Pickton, Tex. 75471

[21] Appl. No.: 461,917

[22] Filed: Jan. 8, 1990

[51] Int. Cl.[5] ..... F41B 5/00

[52] U.S. Cl. ..... 124/23.1; 73/862.45; 73/161; 124/88; 124/90; 29/256

[58] Field of Search ..... 124/1, 23 R, 86, 88, 124/90; 29/246, 256, 266, 426.6, 258, 230; 73/161, 862.45, 862.47

[56] References Cited

U.S. PATENT DOCUMENTS

| | | | |
|---|---|---|---|
| 685,078 | 10/1901 | Willringhaus | 29/256 X |
| 2,235,953 | 3/1941 | Whitfield | 29/266 |
| 3,000,628 | 9/1961 | Kellogg | 124/23 R X |
| 3,055,655 | 9/1962 | Chelf | 124/86 X |
| 4,908,925 | 3/1990 | Johnson | 29/256 X |

FOREIGN PATENT DOCUMENTS

| | | | |
|---|---|---|---|
| 2355980 | 5/1975 | Fed. Rep. of Germany | 124/23.1 |
| 2605398 | 4/1988 | France | 124/88 |
| 626010 | 7/1949 | United Kingdom | 29/230 |

*Primary Examiner*—Randolph A. Reese

*Assistant Examiner*—Jeffrey L. Thompson

*Attorney, Agent, or Firm*—Richards, Medlock & Andrews

[57] ABSTRACT

A portable bow press for facilitating repair and adjustment of an archer's compound-type bow is disclosed which includes a first elongated member having a threaded aperture formed centrally therein and removable structure at each end for engaging the ends of each of the bow limbs. A second elongated member is threaded through the threaded aperture to engage the handle of the bow and apply a force against the handle to remove tension from the bow string and tension cable to allow needed repairs to the various elements of the bow. A sleeve member is mounted on the second elongated member for travel therealong and includes a hook member to hold one end of a scale while the other end of the scale is attached to the center of the bow string. With the removable structure removed from the ends of the first elongated member, the second elongated member engages the handle of the bow and applies a force thereto until the break-over point of the bow is reached at which point the scale will indicate the pounds of draw of the bow.

21 Claims, 3 Drawing Sheets

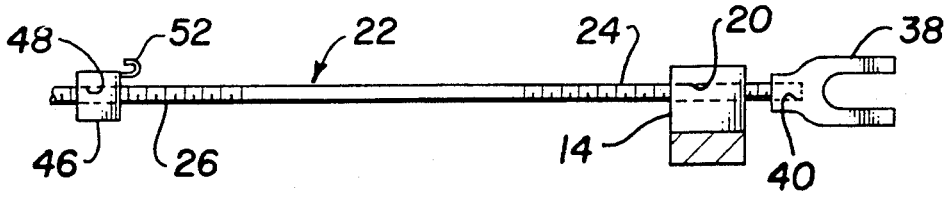
Fig. 3
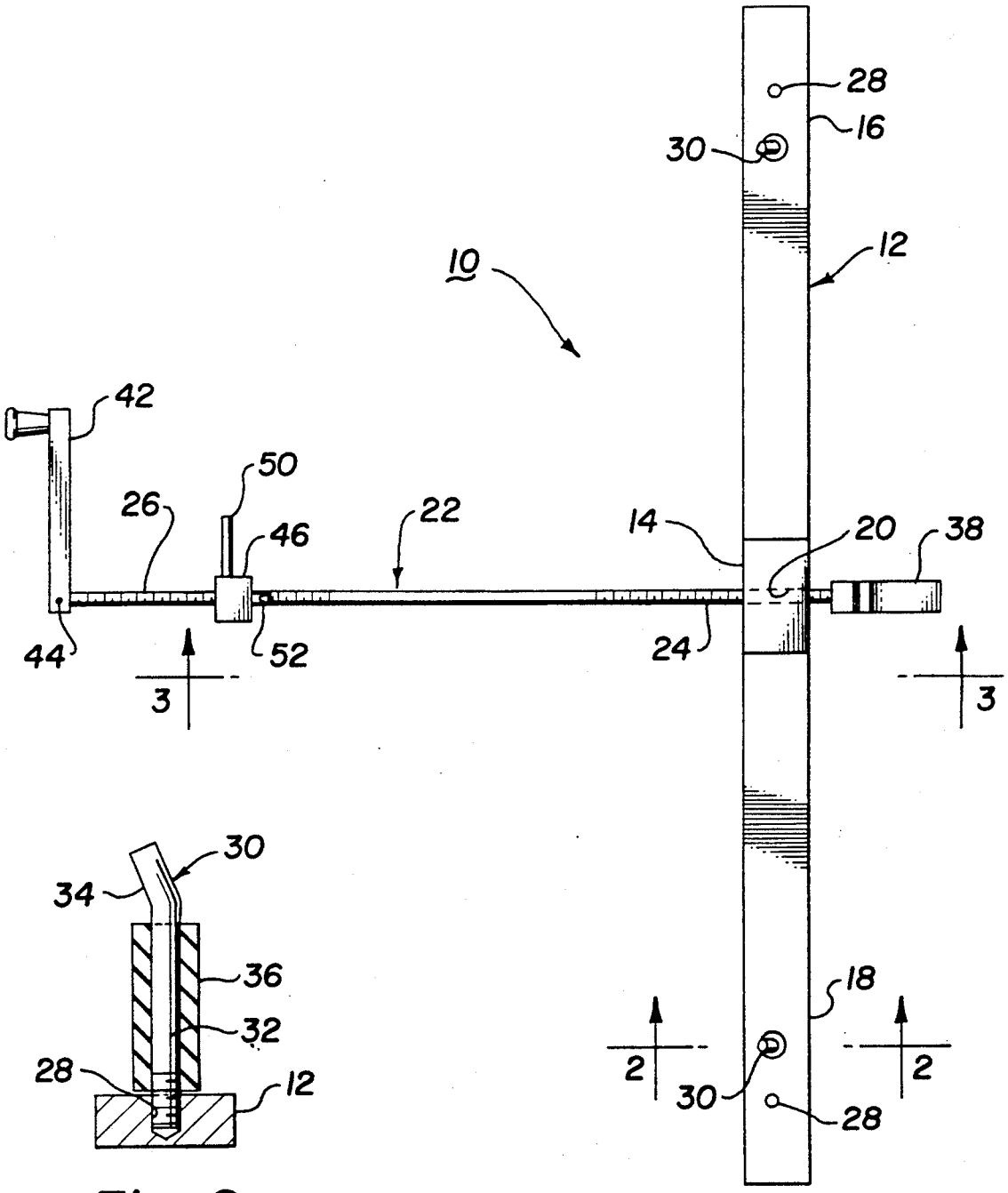
Fig. 2
Fig. 1

PORTABLE BOW PRESS

BACKGROUND OF THE INVENTION

1. Field of the Invention

This invention relates in general to archery bows and more particularly, but not by way of limitation, to new and improved apparatus for changing bow strings, tension cable, wheels, etc., on an archer's compound bow and adjusting or tuning the bow and bow string.

2. Description of the Prior Art

With the development of compound or split limb bows and the widespread use thereof, there has arisen the attendant problem of replacing defective or worn bow strings, tension cables, wheels, etc., and providing and maintaining the proper tension on the bow string.

As is well known to those skilled in the art, the most popular form of compound bow includes two or more eccentrically mounted pulleys or wheels pivotally attached relative the bow limbs and serving to support and control the movement of a bow string which in turn is connected to a tension cable. The popularity of the compound bow is mainly due to the advantage provided in the reduced pull force required at full draw together with the resulting increase in accuracy. The pull on the bow string is high at the beginning of the draw but the arm at this point is able to exert maximum force. As the draw progresses a little beyond mid-point, there is an overcenter action on the eccentrically mounted pulleys or wheels which decreases the draw force needed to maintain the bow string in the drawn position without decreasing the energy stored in the limbs of the bow. Thus, at full draw it is relatively easy to hold the arrow and bow string and much easier to perfect aiming technique and proper finger release resulting in increased accuracy.

As will be appreciated by those familiar with compound bows, the stringing or outfitting of such a bow with its tension cable and bow string is very critical in order to achieve a proper balance or synchronization of the eccentrically mounted pulleys or wheels. The stringing or rigging makes it virtually impossible to unstring the bow when it is not in use. Thus, the limbs of compound bows are always under significant stress, which eventually leads to a degradation of the limb materials and a reduction in the bow weight (the amount of force needed to flex the bow limbs to a condition of full draw of the bowstring) with time for a given setting of the bow. This means that a periodic retuning of compound bows is needed to maintain desired performance levels. Also, over a period of time and with use, various elements of a compound bow, such as the bow string, the tension cable, a wheel or wheels, etc., need to be replaced and/or repaired.

In the past, when repairs or adjustments were required on the compound bow, it was necessary to take the bow to a shop which had a commercial bow press in order to make the adjustments or repairs. When a breakdown occurred or an adjustment was needed while on a hunting trip, the trip could be ruined unless additional spare bows were carried on the trip since a shop with a commercial bow press was not available out in the wilderness. The carrying of spare bows on the trip was a rather large burden.

In the prior art there are some devices which allow the bow string to be changed on a compound-type bow. For example, U.S. Pat. No. 4,074,409 discloses a bow string apparatus with attachment brackets for attaching a pull cord to the bow cables between the opposite eccentric pulley wheels and the bow string attachment points. The pull cord utilizes a low friction sheath member and a sliding locking bar for pulling tension on the bow and locking the bow in a compressed position while changing the bow string.

U.S. Pat. No. 4,599,987 discloses a bow press for restringing a split limb bow and includes a pair of spaced apart handles which engage the exterior of the limbs via slots formed therein. A rotatable lever to which the handles are interconnected, when rotated from a first position to a second position, causes inward compression of the limbs toward each other. An adjustment rod, which is variable in length, reduces or extends the length between the two handles to accommodate bows of various sizes.

The present invention is intended to provide a solution to the requirement that spare bows be carried on each hunting trip. The present invention also overcomes the inconvenience of needing to take the bow to a commercial shop for each adjustment and repair which is not only inconvenient but rather expensive.

SUMMARY OF THE INVENTION

The present invention provides a portable bow press which allows adjustments and repairs to be made to a compound-type bow when and where such adjustments or repairs are desired or required. The portable bow press comprises a first elongated member lying generally in a first plane and having a threaded aperture formed centrally therein with a rod-like structure removably mounted at each end of the first elongated member to engage the end of each of the bow limbs. A second elongated member comprising a threaded rod is threaded through the threaded aperture in the first elongated member and lies generally in a second plane which is perpendicular to said first plane. A U-shaped structure is removably attachable to a first end of the second elongated member to engage the handle portion of the compound-type bow. A handle is removably attached to a second and opposite end of the second elongated member for use in rotating the second elongated member. As the second elongated member is rotated and moved toward the handle portion of the bow, the U-shaped structure applies force to the handle portion while the ends of the bow limbs are held by the rod-like structure at each end of the first elongated member. Tension is thus removed from the bow string and tension cable such that repairs may be made to the compound-type bow. After the repair or change of parts is completed, the second elongated member is rotated in the reverse direction until tension is again placed on the bow string and limbs of the bow.

A sleeve member is mounted on the second elongated member by a threaded aperture formed therein and includes a handle for the operator of the portable bow press to hold. The sleeve member also includes a hook member attached thereto. When the draw or pull weight needs to be checked or the setting changed, the rod-like structures in each end of the first elongated member are removed. A spring scale or the like is connected between the bowstring and the hook member and the second elongated member is rotated such at the U-shaped structure moves the handle portion of the bow away from the bow string until the break-over point is reached. At that point, the scales will indicate the pounds of draw of the bow. If the draw of the bow is to be changed to a different value, the adjustment knobs or screws on the bow will be turned until the desired pounds of draw of the bow is indicated on the scales. The second elongated member is then rotated in the reverse direction until the bow returns to the undrawn position and can be removed from the portable bow press.

Among the advantages offered by the present invention is the provision of a lightweight portable mechanism which is easy to take on the hunt to effect repairs and adjustments to bows in a short time and at any location during the hunt. The mechanism is not complicated, is easy to use and can be provided at a reasonable cost.

BRIEF DESCRIPTION OF THE DRAWING

Other advantages and features of the invention will become more apparent with reference to the following detailed description of the presently preferred embodiment thereof in connection with the accompanying drawing wherein like reference numerals have been applied to like elements, in which:

FIG. 1 is a top plan view of a portable bow press constructed in accordance with the invention;

FIG. 2 is a cross-sectional view taken generally along line 2—2 of FIG. 1;

FIG. 3 is a partial cross-sectional view taken generally along line 3—3 of FIG. 1;

DESCRIPTION OF THE PREFERRED EMBODIMENT

Figure 4:
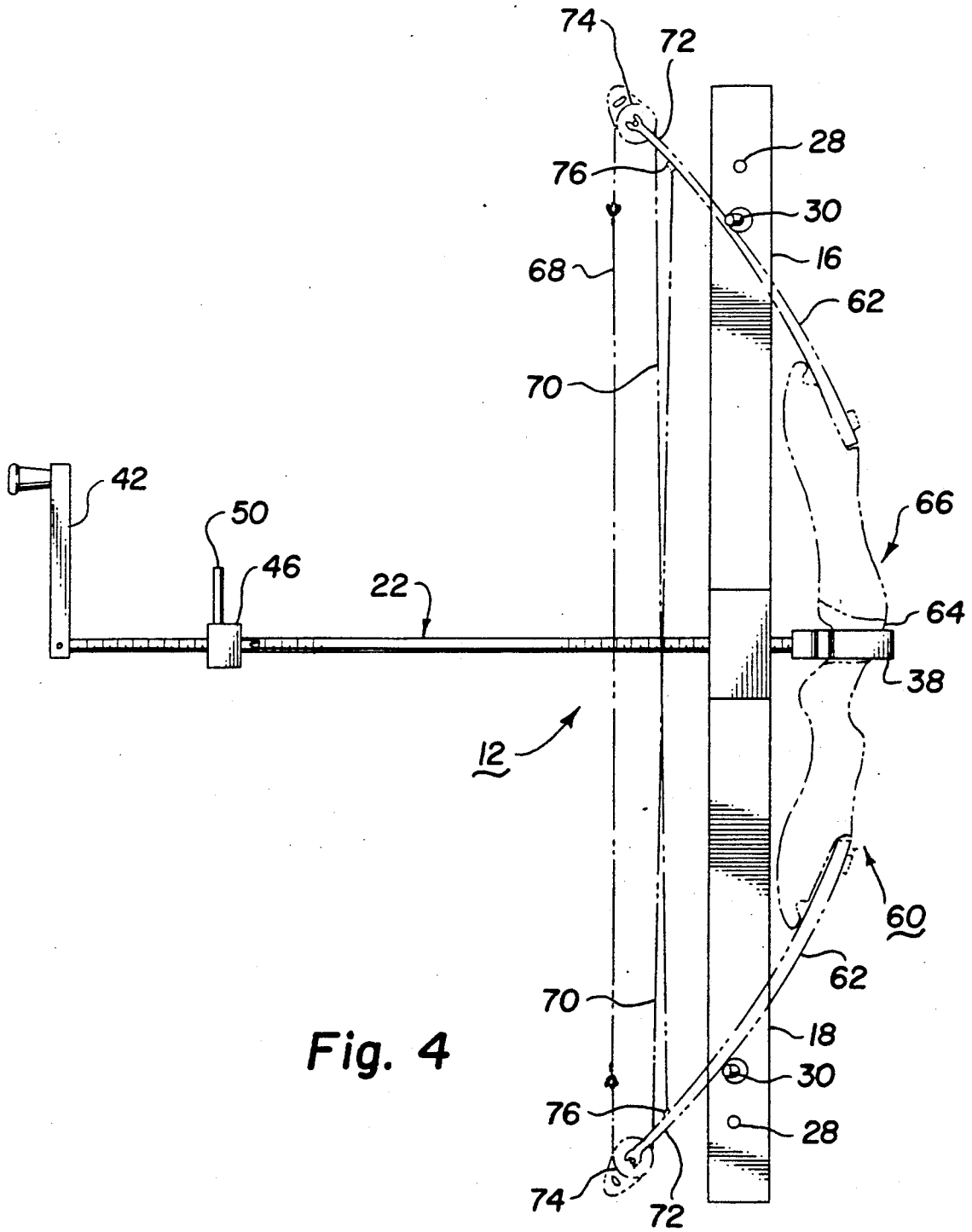
FIG. 4 is a top plan view of the invention as used in repairing or/restringing an exemplary compound-type bow.

Referring to the drawing and FIGS. 1–3 in particular, shown therein and generally designated by the reference character 10 is a portable bow press constructed in accordance with the invention. Portable bow press 10 includes a first elongated member 12 of predetermined length lying generally in a first plane and having a central portion 14, a first end portion 16 and a second end portion 18. In the preferred embodiment first elongated member 12 is generally rectangular in shape and approximately one inch high, two and one-half inches wide and forty-two inches in length. First elongated member 12 could be formed from rectangular metal or plastic tubing, wood, reinforced plastic, etc. Central portion 14 is approximately two inches high and has a threaded aperture 20 formed therethrough at right angles to first elongated member 12 and generally centered with respect to the ends of first elongated member 12. In the preferred embodiment threaded aperture 20 is one half inch in diameter.

First end portion 16 and second end portion 18 each include at least two threaded apertures 28 to removably receive rod-like structures 30. Threaded apertures 28 are separated by approximately three inches with the first threaded aperture 28 positioned approximately five inches from the end of first elongated member 12. Rod-like structures 30 each include a first portion 32 and a second portion 34. First portion 32 is threaded on one end for removably mounting in a threaded aperture 28. Second portion 34 extends from the other end of first portion 32 and is bent or inclined at approximately twenty-two and one-half degrees from the centerline of first portion 32. A resilient material 36, such as rubber or a rubber compound, covers generally all of first portion 32 which extends above the surface of first elongated member 12 when rod-like structure 30 is mounted in the first elongated member 12.

Second elongated member 22 of predetermined length is positioned generally in a second plane perpendicular to the first plane and includes a first portion 24 and a second portion 26. In the preferred embodiment second elongated member 22 comprises a one-half inch threaded rod or bolt which is approximately thirty-six inches in length and is threaded along generally all thirty-six inches. Second elongated member 22 is moved and threaded into threaded aperture 20 for movement in a first direction in the second plane toward the first elongated member 12 and for movement in a second direction in the second plane away from the first elongated member 12.

A generally U-shaped or saddle-type structure 38 is removably mounted at the end of first portion 24 of second elongated member 22 and is structured to fit over or around the handle or handgrip portion of a compound-type bow. U-shaped structure 38 includes a cavity 40 sized to receive the end of first portion 24 of second elongated member 22 such that second elongated member 22 may rotate with respect to first elongated member 12 while U-shaped structure 38 will not rotate but will maintain a constant position with respect to the handle portion of the compound-type bow, such as that shown in FIGS. 1, 4 and 5.

First handle 42 is removably attached by fastening means 44 to the end of second portion 26 of second elongated member 22 to provide means to easily rotate second elongated member 22 and provide leverage for ease of applying additional force to the movement of second elongated member 22 with respect to first elongated member 12.

Sleeve member 46 is removably mounted on second elongated member 22 and includes a threaded aperture 48 formed therethrough to mate with and coact with threaded second elongated member 22. Second handle 50 is attached to sleeve member 46 and extends therefrom at a generally right angle with respect to second elongated member 22. Second handle 50 may be used to assist the operator of the portable bow press during the rotation of second elongated member 22. A hook member 52 is attached to sleeve member 46 extending toward first elongated member 12 and is in alignment with second elongated member 22. The function of hook member 52 will be discussed below with reference to FIG. 5.

FIG. 4 illustrates the arrangement of the portable bow press 10 in operation with an exemplary compound-type bow 60, shown in phantom, to perform the task of changing parts on bow 60. A rod-like structure 30 is removably mounted in one of the threaded apertures 28 in both the first end portion 16 and second end portion 18. The particular location of the apertures which are chosen will be determined by the size of the bow to be repaired using the portable bow press 10. The bow 60 is positioned on first elongated member 12 such that a particular longitudinally elongated limb 62 is inboard of each rod-like structure 30 as shown in FIG. 4. U-shaped structure 38 is positioned against and around the generally central section 64 of handle portion 66.

To release the tension on the bowstring 68 and tension cable 70, the operator turns first handle 42 in a clockwise direction (as viewed from the operator's position) with one hand while holding second handle 50 in the other hand. Second elongated member 22 moves in a first direction toward first elongated member 12 and away from the operator thereby pushing handle portion 66 of bow 60 away from first elongated member 12 and forcing ends 72 of limbs 62 inwardly toward each other and toward second elongated member 22. At some particular point of the turning of first handle 42, ends 72 will be forced inwardly a sufficient amount to remove the tension from bow string 68 and tension cable 70 and then the bow string 68, tension cable 70, wheels 74, anchor mechanism 76 for the tension cables 70, etc., can be repaired, replaced, etc.

After the changes and/or repairs are completed, first handle 42 is turned in the counterclockwise direction causing second elongated member 22 to move in a second direction away from first elongated member 12 and toward the operator. This movement of second elongated member 22 and U-shaped structure 38 allows ends 72 to move outwardly away from each other and from second elongated member 22 and, at some point, apply tension back on the bow string 68 and tension cable 70. Bow 60 may then be removed from the portable bow press 10.

Figure 5:
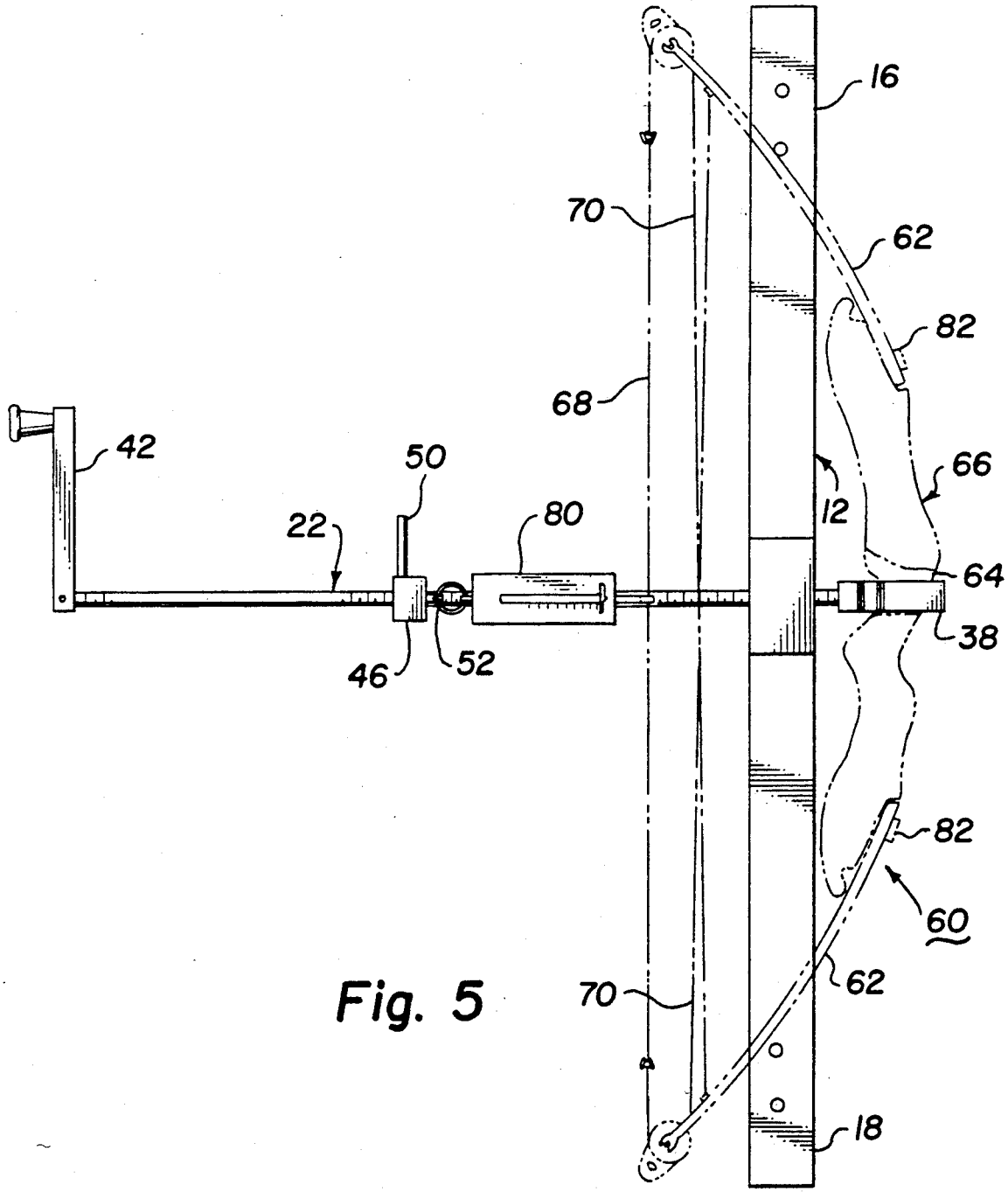
FIG. 5 is a top plan view of the invention as used in tuning or setting the draw of an exemplary compound-type bow.

FIG. 5 illustrates the arrangement of the portable bow press 10 in operation with an exemplary compound-type bow 60, shown in phantom, to perform the talk of setting the draw or pull weight of the bow 60. The rod-like structures 30 are removed from first elongated member 12.

Bow 60 is positioned on first elongated member 12 such that U-shaped structure 38 is positioned against and around the generally central section 64 of handle portion 66. One end of scales 80 is removably attached to hook member 52 while the other end of scales 80 is removably attached to bow string 68. As the operator turns first handle 42 in a clockwise direction with one hand while holding second handle 50 in the other hand, second elongated member 22, with U-shaped structure 38 operatively attached, pushes handle portion 66 of bow 60 away from first elongated member 12 and scales 80 causing the center of the bowstring 68 to be "drawn back" relative to the handle portion 66, thereby "drawing the bow" just as one would do to shoot an arrow with the bow. First handle 42 is rotated until the "break-over" point of the bow 60 is reached. At the "break-over" point the reading on scales 80 indicates the "pounds of draw" or "draw" of the bow 60. If it is desired to change the draw of the bow 60, adjustment is made by tightening or loosening the adjusting mechanisms 82 associated with each limb 62 depending upon whether the draw is to be increased or decreased.

After the draw has been adjusted, or at least checked, first handle 42 is turned in the counterclockwise direction causing second elongated member 22 to move toward the operator and allow the bow string 68 to assume the undrawn position. Bow 60 can then be removed from the portable bow press 10.

Although the present invention has been described with reference to a presently preferred embodiment, it will be appreciated by those skilled in the art that various modifications, alternatives, variations, etc., may be made without departing from the spirit and scope of the invention as defined by the appended claims.

What is claimed:

1. A portable bow press for a compound-type bow which includes at least a handle portion, two longitudinally elongated limbs extending in generally opposite directions from said handle portion and a bow string, said portable bow press comprising:

a first elongated member of predetermined length lying generally in a first plane and having a central portion, a first end portion and a second end portion;

a second elongated member of predetermined length having a first portion and a second portion;

means formed in said central portion of said first elongated member to engage said second elongated member for movement of said second elongated member in a second plane generally perpendicular to said first plane, said movement being relative to said first elongated member;

means formed on said second elongated member to coact with said means formed in said central portion to allow movement of said second elongated member along said second plane relative to said first elongated member;

means mounted on said first portion of said second elongated member and structured to engage the handle portion of the compound-type bow;

means removably mounted on said first end portion of said first elongated member and structured to engage one of the two longitudinally elongated limbs, said means removably mounted on said first end portion of said first elongated member comprising a rod-like structure having a first portion and a second portion with said first portion removably secured to said first end portion at a generally right angle thereto with said second portion extending from said first portion at an angle of approximately twenty-two and one-half degrees with respect to the center line of said first portion; and means removably mounted on said second end portion of said first elongated member and structured to engage the other one of the two longitudinally elongated limbs;

whereby upon movement of said second elongated member in a first direction toward said first elongated member, tension is provided on said two longitudinally elongated limbs with respect to said handle portion such that tension is removed from the bow string and repairs may be made to the compound-type bow.

2. A portable bow press as defined in claim 1 wherein said first elongated member is rectangular in cross-section.

3. A portable bow press ad defined in claim 1 wherein said second elongated member comprises a rod-like member.

4. A portable bow press as defined in claim 1 wherein said formed in said central portion comprises a threaded aperture of predetermined dimension.

5. A portable bow press as defined in claim 4 wherein said means formed on said second elongated member comprises a threaded surface structured and dimensioned to coact with said threaded aperture formed in said central portion

6. A portable bow press as defined in claim 1 wherein said means mounted on said first portion of said second elongated member comprises a generally U-shaped structure dimensioned to fit around the handle portion of the compound type bow.

7. A portable bow press as defined in claim 1 wherein said means removably mounted on said second end portion of said first elongated member comprises a rod-like structure having a first portion and a second portion with said first portion removably secured to said second end portion at a generally right angle thereto with said second portion extending from said first portion at an angle of approximately twenty-two and one-half degrees with respect to the center line of said first portion.

8. A portable bow press as defined in claim 1 further including handle means removably attached to said second portion of said second elongated member to allow force to be applied to said second elongated member to move said second elongated member in a first direction toward or in a second direction away from said first elongated member.

9. A portable bow press for a compound-type bow which includes at least a handle portion, two longitudinally elongated limbs extending in generally opposite directions from said handle portion and a bow string, said portable bow press comprising:

a first elongated member of predetermined length lying generally in a first plane and having a central portion, a first end portion and a second end portion;

a second elongated member of predetermined length having a first portion and a second portion;

means formed in said central portion of said first elongated member to engage said second elongated member for movement of said second elongated member in a second plane generally perpendicular to said first plane, said movement being relative to said first elongated member;

means formed on said second elongated member to coact with said means formed in said central portion to allow movement of said second elongated member along said second plane relative to said first elongated member;

means removably mounted on said first portion of said second elongated member and structured to engage the handle portion of the compound-type bow; and a sleeve member mounted on said second elongated member and structured to coact with said means formed on said second elongated member to allow relative movement between said sleeve member and said second elongated member, said sleeve member further including means for removably holding one end of a scales means while the other end of the scales means is attached to the bow string of the compound-type bow while said means removably mounted on said first portion of said second elongated member is in engagement with the handle portion of the compound-type bow;

whereby movement of said second elongated member in a first direction toward said first elongated member will cause the scales means to indicate the pounds of draw of the compound-type bow so that adjustment of the draw may be made if desired.

10. A portable bow press as defined in claim 9 further including means removably mounted on said first end portion of said first elongated member and structured to engage one of the two longitudinally elongated limbs.

11. A portable bow press as defined in claim 10 further including means removably mounted on said second end portion of said first elongated member and structured to engage the other one of the two longitudinally elongated limbs.

12. A portable bow press as defined in claim 11 wherein said means removably mounted to said second end portion of said first elongated member comprises a rod-like structure having a first portion and a second portion with said first portion removably mounted to said first end portion at a generally right angle thereto with said second portion extending from said first portion at an angle of approximately twenty-two and one-half degrees with respect to the center line of said first portion.

13. A portable bow press as defined in claim 10 wherein said means removably mounted on said first end portion of said first elongated member comprises a rod-like structure having a first portion and a second portion with said first portion removably secured to said first end portion at a generally right angle thereto with said second portion extending from said first portion at an angle of approximately twenty-two and one-half degrees with respect to the centerline of said first portion.

14. A portable bow press as defined in claim 9 wherein said first elongated member is rectangular in cross-section.

15. A portable bow press as defined in claim 9 wherein said second elongated member comprises a rod-like member.

16. A portable bow press as defined in claim 9 wherein said means formed in said central portion comprises a threaded aperture of predetermined dimensions.

17. A portable bow press as defined in claim 16 wherein said means formed on said second elongated member comprises a threaded surface structured and dimensioned to coact with said threaded aperture formed in said central portion.

18. A portable bow press as defined in claim 9 wherein said means removably mounted on said first portion of said second elongated member comprises a generally U-shaped structure dimensioned to fit around the handle portion of the compound type bow.

19. A portable bow press as defined in claim 9 further including handle means removably attached to said second portion of said second elongated member to allow force to be applied to said second elongated member to move said second elongated member in a first direction toward or in a second direction away from said first elongated member.

20. A portable bow press as defined in claim 9 further including handle means attached to said sleeve member, said handle means extending at a generally right angle with respect to said second elongated member.

21. A portable bow press as defined in claim 9 wherein said means for removably holding one end of a scales means comprises a hook member.

* * * * *

UNITED STATES PATENT AND TRADEMARK OFFICE

CERTIFICATE OF CORRECTION

PATENT NO. : 5,022,377

DATED : June 11, 1991

INVENTOR(S) : Richard L. Stevens

It is certified that error appears in the above-identified patent and that said Letters Patent is hereby corrected as shown below:

Column 3, line 30, change "or/restringing" to
---or restringing---

Column 5, line 29, change "talk" to ---task---

Column 6, line 50, change "ad" to ---as---

Column 6, line 54, after "said" (first occurrence) insert
---means---

Column 8, line 46, change "compound type" to ---compound-type---

Signed and Sealed this

Twenty-ninth Day of September, 1992

*Attest:*

DOUGLAS B. COMER

*Attesting Officer*

*Acting Commissioner of Patents and Trademarks*